US006389819B1

(12) United States Patent
Zhu et al.

(10) Patent No.: US 6,389,819 B1
(45) Date of Patent: May 21, 2002

(54) PULSE TUBE REFRIGERATOR

(75) Inventors: Shaowei Zhu; Shin Kawano; Masafumi Nogawa; Tatsuo Inoue, all of Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/665,660

(22) Filed: Sep. 20, 2000

(30) Foreign Application Priority Data

Sep. 20, 1999 (JP) ..... 11-265702

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS 5,275,002 A * 1/1994 Inoue et al. ..... 62/6
5,711,156 A * 1/1998 Matsui et al. ..... 62/6
5,845,498 A * 12/1998 Matsui et al. ..... 62/6
5,966,943 A * 10/1999 Mitchell ..... 62/6
5,974,807 A * 11/1999 Gao et al. ..... 62/6

OTHER PUBLICATIONS

Masayoshi Yanai, "Pulse Tube Cryocooler", *ISTEC Journal*, vol. 9, Nov. 3, 1996, pp. 20–24.

* cited by examiner

*Primary Examiner*—Ronald Capossela
(74) *Attorney, Agent, or Firm*—Burns, Doane, Swecker Mathis, LLP

(57) ABSTRACT

A pulse tube refrigerator includes a compressor, a first heat exchanger, a first regenerator, a first cold head, a first pulse tube, a first radiator, a second regenerator, a second cold head, a second pulse tube, a second radiator, an orifice and a buffer tank which are connected in series. A first cooling part consists of the first heat exchanger, the first regenerator, the first cold head, the first pulse tube and the first radiator. A second cooling part consists of the first radiator, the second regenerator, the second cold head, the second pulse tube and the second radiator. The first radiator forms not only the radiator of the first cooling part, but also the heat exchanger of the second cooling part.

19 Claims, 7 Drawing Sheets

PULSE TUBE REFRIGERATOR

This application is based on and claims priority under 35 U.S.C. §119 with respect to Japanese Patent Application No. 11(1999)-265702 filed on Sep. 20, 1999, the entire content of which is incorporated herein by reference.

FIELD OF THE INVENTION

The present invention generally relates to a refrigerator. More particularly, the present invention pertains to a pulse tube refrigerator having improved cooling efficiency or cooling power.

BACKGROUND OF THE INVENTION

Recent research and development of a pulse tube refrigerator has led to the development of a supercooling refrigerator. The pulse tube refrigerator provides cooling by using adiabatic expansion of an operating gas in a pulse tube refrigerator.

Various types of pulse tube refrigerators are disclosed in publications concerning cooling technology (e.g., ISTEC Journal, Vol.9, No.3 "Pulse Tube Cryocooler").

One traditional type of pulse tube refrigerator is shown in FIG. 7. As shown in FIG. 7, this pulse tube refrigerator 81 includes a compressor 82, a cooling device 83, a regenerator 84, a cold head 85, a pulse tube 86, a radiator 87, an orifice 88, and a buffer tank 89, which are connected in series. A cooling part 90 is accommodated in a vacuum vessel 81a and consists of the cooling device 83, the regenerator 84, the cold head 85, the pulse tube 86 and the radiator 87.

The compressor 82 includes a compression cylinder 91 and a compression piston 92 that is positioned in the compression cylinder 91 for reciprocating movement. A compression chamber 93 is defined between a front surface of the compression piston 92 and the cooling device 83. The compressor 82 moves by applying a driving force generated by a driving unit such as a motor (not shown in FIG. 7) so that the compression piston 92 reciprocates in the compression cylinder 91. An operating gas in the pulse tube refrigerator 81 is thus compressed and expanded alternately.

Heat generated in the pulse tube refrigerator 81 is conducted to the cooling device 83 and the radiator 87, and is heat exchanged therein. The heat exchanged by the cooling device 83 is discharged to a coolant flowing in a first cooling path 94. The heat exchanged by the radiator 87 is discharged to a coolant flowing in a second cooling path 95.

Regenerative material 96 is located in the regenerator 84 for effecting heat exchange of the operating gas. A plurality of layered mesh screens made of stainless steel or phosphor bronze may be used as the regenerative material 96. When the operating gas flows from the hot end of the regenerator 84 which is connected with the cooling device 83 to the cold end of the regenerator 84 which is connected to the cold head 85, the operating gas is cooled by discharging heat to the regenerative material 95. When the operating gas flows from the cold end of the regenerator 84 to the hot end of the regenerator 84, the operating gas is heated by absorbing heat from the regenerative material 96.

The cold head 85 is connected to the cold end of the regenerator 84. A cooling object attaches with the cold head 85 and the object is cooled.

The pulse tube 86 is connected to the cold head 85. The pulse tube 85 is a hollow cylindrical tube and is generally made of stainless steel.

The radiator 87 is connected to the buffer tank 89 via the orifice 88. The buffer tank 89 and the orifice 88 are used as a phase shifter, which adjusts the amount of phase difference between a pressure oscillation and a displacement of the operating gas.

The operation of the pulse tube refrigerator is described below. As the compressor 82 is driven, the compression piston 92 reciprocates in the compression cylinder 93. When the compression piston 92 moves forward, the operating gas in the compression chamber 93 and the cooling part 90 connected to the compression chamber 93 is compressed and moves from the compression chamber 93 to the cooling part 90. When the compression piston 92 moves rearward, the operating gas in the compression chamber 93 and the cooling part 90 expands and the operating gas in the cooling part 90 moves from the cooling part 90 to the compression chamber 93.

By repeating the reciprocating movement of the compression piston 92 in the compression cylinder 91, the pressure in the pulse tube 86 alternately oscillates from high pressure to low pressure and the operation gas moves reciprocally in the pulse tube 86. Then, an amount of the phase difference between the pressure oscillation and displacement of the operating gas in the pulse tube 86 is adjusted by the buffer tank 89 and the orifice 88. Therefore, the operating gas in the pulse tube 83 moves to the hot end side of the pulse tube 86 and is adiabatically compressed at the hot end. After that, it moves to the cold end side of the pulse tube 86 and is adiabatically expanded at the cold end. The heat generated by the substantially adiabatic compression at the hot end of the pulse tube 86 is conducted to the radiator 87 and is heat exchanged. The cold generated by the substantially adiabatic expansion at the cold end of the pulse tube 86 is conducted to the cold head 85. By repeating the operation described above, cold is generated at the cold head 85.

The traditional type of pulse tube refrigerator described above is inferior to a Stirling type refrigerator with respect to its cooling power. The Stirling type refrigerator has an expansion piston and the expansion work of the operation gas in the Stirling type refrigerator can be used to move the expansion piston. On the contrary, the traditional pulse tube refrigerator does not utilize the expansion piston. Therefore, the expansion work of the operating gas in the pulse tube refrigerator is changed to heat and the heat is discharged to the atmosphere by the radiator. Because the expansion work of the operating gas in the pulse tube refrigerator cannot be used as the work that contributes to generating the cold, the cooling power of the pulse tube refrigerator is inferior to the cooling power of the Stirling type refrigerator.

A need thus exists for a pulse tube refrigerator having improved cooling power.

SUMMARY OF THE INVENTION

One aspect of the present invention involves a pulse tube refrigerator that includes a series of cooling parts having one end side and an opposite end side, and a pressure oscillation source. Each cooling part is comprised of at least a regenerator, a cold head, and a pulse tube which are connected in series. The pressure oscillation source is connected to one of the cooling parts disposed at one end side of the series.

The expansion work generated in one cooling part can be used as compression work of the other cooling part that is connected to the one cooling part. The compression work of the other cooling part contributes to generate cold. Therefore, the expansion work of the operating gas in one cooling part can be used efficiently for cold generation in the other cooling part, and an improvement of the cooling power can be achieved.

The cooling parts include a first cooling part and a second cooling part. The first cooling part is defined by at least a first regenerator, a first cold head, and a first pulse tube. The first regenerator possesses a hot end and a cold end, and the hot end of the first regenerator is connected to the pressure oscillation source. The first cold head is connected to the cold end of the first regenerator. The first pulse tube has a hot end and a cold end, and the cold end of the first pulse tube is connected to the first cold head. The second cooling part includes at least a second regenerator, a second cold head, and a second pulse tube. The second regenerator has a hot end and a cold end, and the hot end of the second regenerator is connected to the first pulse tube. The second cold head is connected with the cold end of the second regenerator. The second pulse tube has a hot end and a cold end, and the cold end of the second pulse tube is connected to the second cold head.

Because the first pulse tube (i.e., the hot end of the first pulse tube) of the first cooling part is connected with the hot end of the second regenerator of the second cooling part, the expansion work generated in the first cooling part (i.e, the hot end of the first pulse tube) can be used as the compression work for the second cooling part. Also, the compression work of the second cooling part contributes to generate cold in the second cooling part. Therefore, the expansion work of the operating gas in the first cooling part can be used efficiently for cold generation in the second cooling part, and an improvement of the cooling power can be achieved.

A first cooling device and a first radiator may be attached in order to discharge heat generated in the first cooling part. The first cooling device can be disposed at the portion which contacts the hot end of the first regenerator. The first radiator is preferably disposed at a portion contacting the hot end of the first pulse tube.

A second cooling device and a second radiator may be attached in order to discharge heat generated in the second cooling part. The second cooling device can be disposed at the portion which contacts the hot end of the second regenerator, and the first radiator can be used for the second cooling device. The second radiator is preferably disposed at a portion contacting the hot end of the second pulse tube.

According to another aspect of the invention, a pulse tube refrigerator having a pressure oscillation source includes a first regenerator possessing a hot end connected to the pressure oscillation source and a cold end, a first cold head connected with the cold end of the first regenerator, and a first pulse tube having a hot end and a cold end, with the cold end of the first pulse tube being connected to the first cold head. The first regenerator, the first cold head and the first pulse tube form a first cooling part. A second regenerator possesses a hot end and a cold end, with the hot end of the second regenerator being connected to the hot end of the first pulse tube. A second cold head is connected to the cold end of the second regenerator, and a second pulse tube having a hot end and a cold end is connected to the cold end of the second cold head. The second regenerator, the second cold head and the second pulse tube form a second cooling part.

Another aspect of the invention involves a pulse tube refrigerator that includes a first cooling part having a regenerator, a cold head and a pulse tube arranged in series, with the pulse tube being adapted to generate expansion work of operating gas in the first cooling part, and a second cooling part connected to the first cooling part, with the expansion work of the operating gas generated by the first cooling part being used as the compressor for operating gas in the second cooling part.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
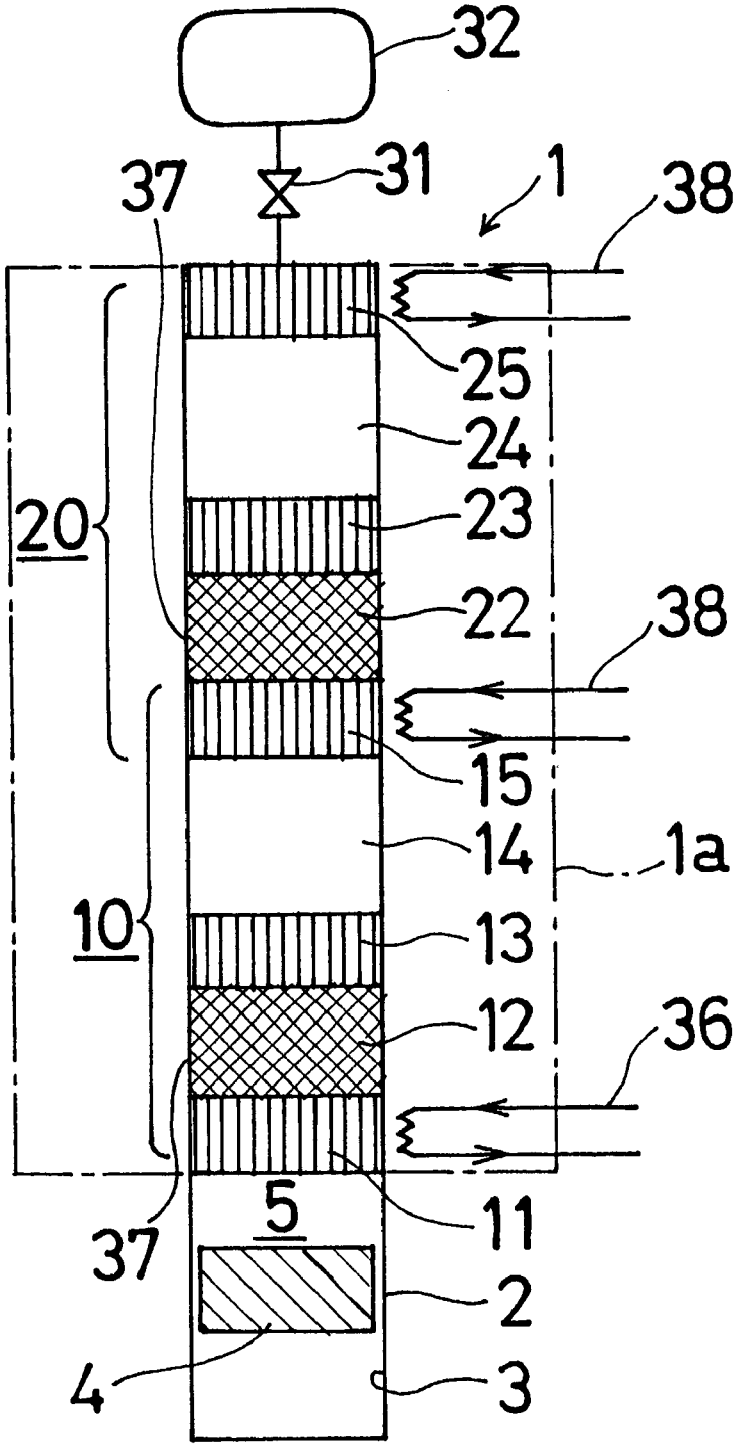
FIG. 1 is a schematic illustration of a pulse tube refrigerator according to a first embodiment of the present invention.

The pulse tube refrigerator 1 according a first embodiment of the present invention is illustrated in FIG. 1 and generally includes a plurality of cooling parts. According to a preferred version of the invention, the cooling parts include a first cooling part 10 and a second cooling part 20 that are connected in series. The first cooling part 10 and the second cooling part 20 are both accommodated in a vacuum vessel 1*a*.

Considered in more detail, the pulse tube refrigerator 1 includes a compressor 2, a first cooling device 11, a first regenerator 12, a first cold head 13, a first pulse tube 14, a first radiator 15, a second regenerator 22, a second cold head 23, a second pulse tube 24, a second radiator 25, an orifice 31 and a buffer tank 32. These features are connected in series.

The first cooling part 10 consists of the first cooling device 11, the first regenerator 12, the first cold head 13, the first pulse tube 14 and the first radiator 15. The second cooling part 20 consists of the first radiator 15, the second regenerator 22, the second cold head 23, the second pulse tube 24 and the second radiator 25. The first radiator 15 functions not only as the radiator for the first cooling part 10 but also as the cooling device for the second cooling part 20.

The compressor 2 includes a compression cylinder 3 and a compression piston 4 disposed for reciprocating movement in the compression cylinder 3. Although not specifically shown, a piston ring is provided around the compression piston 4. A compression chamber 5 is thus formed between the compression piston 4 and the first cooling device 11. The compressor 2 is driven by applying driving power from a driving source (not shown) to compress and expand an operating gas such as helium gas in the pulse tube refrigerator 1. The compressor 2 thus functions as a pressure oscillation source that generate a pressure oscillation in the pulse tube refrigerator 1.

The first cooling device 11 is connected with the compressor 2. The first cooling device 11 has a plurality of holes penetrating along the flow direction of the operating gas. The first cooling device 11 functions to discharge the heat of the operating gas flowing therein to the coolant which flows in a coolant path 36.

The first regenerator 12 is connected with the first cooling device 11. The first regenerator 12 consists of a cylindrical housing in which is located a plurality of meshes. The meshes are made of, for example, stainless steel, phosphor bronze or other known materials. The first regenerator 12 is used for heat exchanging with the operating gas in the first cooling part 10. The operating gas is gradually cooled while it flows through the first regenerator 12 to the first cold head 13, and the operating gas is gradually heated while it flows through the first regenerator 12 to the first cooling device 11.

The first regenerator 12 has a hot end and a cold end. The hot end of the first regenerator 12 is the end at the side that contacts the first cooling device 11 and the cold end of the first regenerator 12 is the end at the opposite side from the hot end. The first cold head 13 is connected with the cold end of the first regenerator 12. The first cold head 13 functions as a cold generating part of the first cooling part 10. The first cold head 13 has a plurality of holes penetrated along the flow direction of the operating gas and is made of a material possessing good conductivity such as copper.

The first pulse tube 14 is connected to the first cold head 13. The first pulse tube 14 is a hollow tube made of a material possessing poor conductivity such as stainless steel.

The first pulse tube 14 has a hot end and a cold end. The cold end is one side end which contacts with the first cold head 13 and the hot end is the other side which is opposite side of the cold end. The first radiator 15 contacts the hot end of the first pulse tube 14. The first radiator 15 has a plurality of holes which penetrate along the flow direction of the operating gas and is made of copper. The first radiator 15 functions to discharge the heat of the operating gas flowing therein to the coolant which flows in a coolant path 38.

The first radiator 15 is also connected with the second regenerator 22. The second regenerator 22 has the same structure as the first regenerator 12. The second regenerator 22 functions to effect heat exchange with the operating gas in the second cooling part 20. The operating gas is gradually cooled while it flows through the second regenerator 22 to the second cold head 23, and the operating gas is gradually heated as it flows through the second regenerator 22 to the first radiator 15.

The second regenerator 22 has a hot end and a cold end. The hot end is the end of the second regenerator 22 at the side which contacts the first radiator 15 and the cold end is the other end of the second regenerator 22 opposite the hot end. The second cold head 23 is connected with the cold end of the second regenerator 22 and has the same structure as the first cold head 13. The second cold head 13 functions as a cold generating part of the second cooling part 20. In addition, the second pulse tube 24 is connected with the second cold head 23 and has the same structure as the first pulse tube 14.

The second pulse tube 24 also has a hot end and a cold end. The cold end is the end that is on the side which contacts the second cold head 23 and the hot end is the other end which is opposite the cold end. The second radiator 25 contacts the hot end of the second pulse tube 24 and possesses the same structure as the first radiator 15. The second radiator 25 is used for discharging the heat of the operating gas flowing therein to the coolant which flows in a coolant path 38.

The second radiator 25 is connected to the buffer tank 32 via the orifice 31. The orifice 31 controls the flow amount of the operating gas flowing between the second pulse tube 24 and the buffer tank 32. The buffer tank 32 has a large volume compared with sum of the volume of the first cooling part 10 and the volume of the second cooling part 20. The orifice 31 and the buffer tank 32 adjust the amount of phase difference between the pressure oscillation and the displacement of the operating gas in the pulse tube refrigerator 1.

The operation of the pulse tube refrigerator 1 described above is as follows. When the compression piston 4 moves forward, the operating gas in the compression chamber 5 is compressed and moves to the first cooling part 10. Therefore, compression of the gas in the first cooling part 10 and the second cooling part 20 communicating with the first cooling part 10 occurs and a high pressure state is achieved.

When the compression piston 4 moves rearward, the operating gas in the first cooling part 10 moves into the compression chamber 5. Therefore, the first cooling part 10 and the second cooling part 20 are expanded and the low pressure state is achieved.

By repeating the reciprocating movement of the compression piston 4 as described above, pressure oscillations in the first cooling part 10 and the second cooling part 20 occur. Then, the amount of the phase difference between the pressure oscillation and displacement of the operating gas in the first cooling part 10 and the second cooling part 20 is adjusted by the buffer tank 32 and the orifice 31. Accordingly, the operating gas in the first pulse tube 14 and the second pulse tube 24 moves to the hot end of the first pulse tube 14 and the hot end of the second pulse tube 24 and generates heat while being in a state of adiabatic compression, and moves to the cold end of the first pulse tube 14 and the cold end of the second pulse tube 24 and generates cold while being in a state of adiabatic expansion. The heat generated at the hot end of the first and second pulse tubes 14, 24 is conducted to the first and the second radiators 15, 25. The cold generated at the cold end of the first and second pulse tubes 14, 24 is conducted to the first and the second cold head 13, 23. By repeating the operation described above, cold is generated at the first cold head 13 and the second cold head 23.

When operating the pulse tube refrigerator 1 described above, the expansion work of the operating gas performed at the hot end of the first pulse tube 14 is used to effect the compression work for the second cooling part 20. That is, the expansion work of the operating gas generated by the first cooling part is used as a compressor for the second cooling part 20. Accordingly, the pulse tube refrigerator 1 described above exhibits an advantageous cooling effect.

Figure 2:
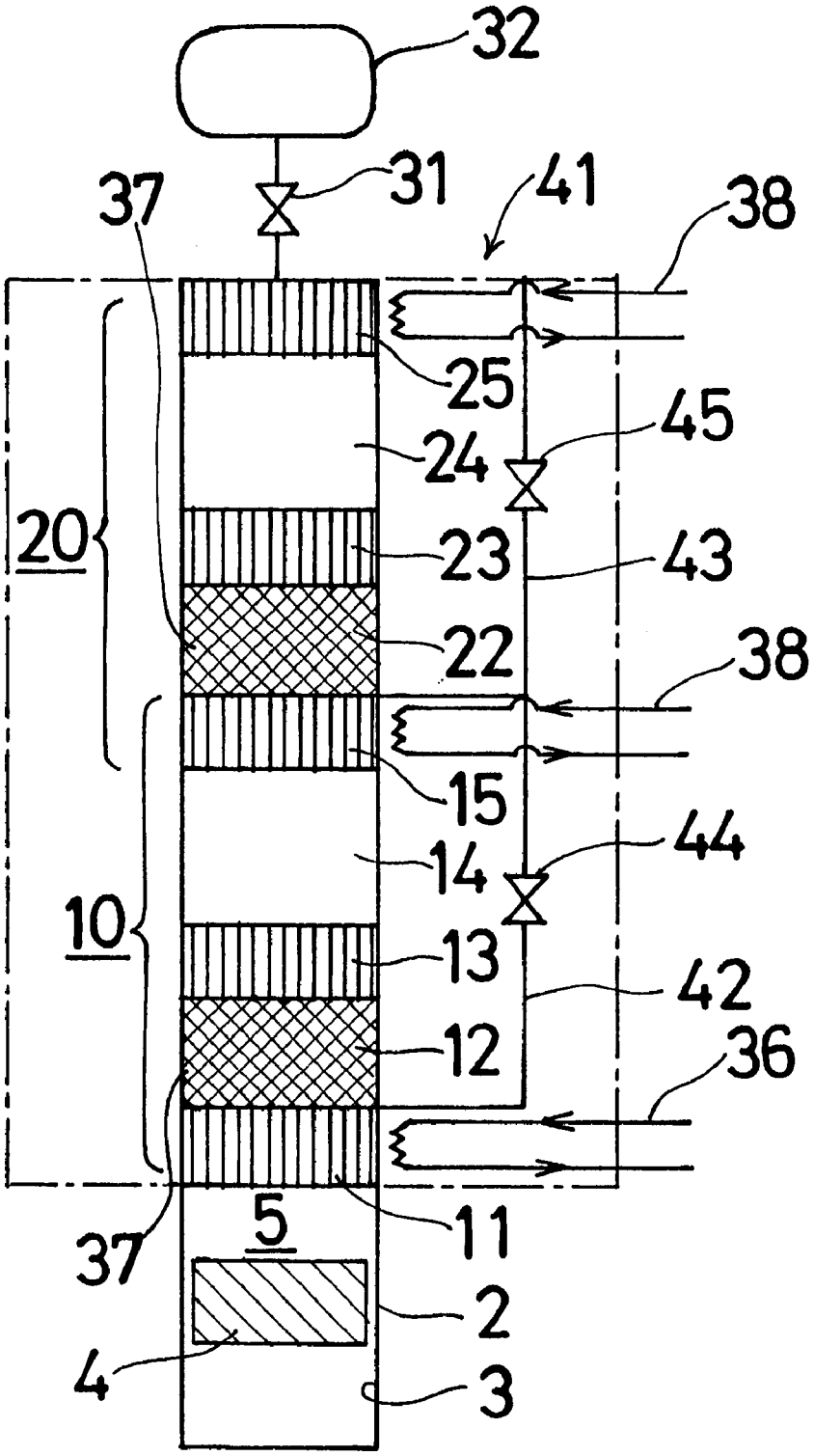
FIG. 2 is a schematic illustration of a pulse tube refrigerator according to a second embodiment of the present invention.

The pulse tube refrigerator 41 according to a second embodiment of the present invention is shown in FIG. 2. This version of the pulse tube refrigerator is the same as that shown in FIG. 1 and described above, excerpt that it also includes a first bypass 42 and a second bypass 43. One end of the first bypass 42 is connected at a portion between the hot end of the first regenerator 12 and the first cooling device 11, while the other end of the first bypass 42 is connected at a portion between the first radiator 15 and the hot end of the second regenerator 22. One end of the second bypass 43 is connected to the portion between the first radiator 15 and the hot end of the second regenerator 22, while the other end of the second bypass 43 is connected with the second radiator 25. An orifice 44 is interposed on the first bypass 42 and an orifice 45 is interposed on the second bypass 43. Generally speaking, a pulse tube refrigerator having a bypass with an interposed orifice bypassing the regenerator and the pulse tube like the pulse tube refrigerator 41 shown in FIG. 2 is referred to as a double inlet type pulse tube refrigerator.

The first bypass 42 with the interposed orifice and the second bypass 44 with the interposed orifice 45 modify the phase difference between the pressure oscillation and the displacement of the operating gas. Accordingly, the phase difference between the pressure oscillation and the displacement can be controlled so as to increase cooling power. Thus, according to this second embodiment of the pulse tube refrigerator, the phase difference between the pressure oscillation and the displacement can be controlled more appropriately and an increase in the cooling power can be obtained.

Figure 3:
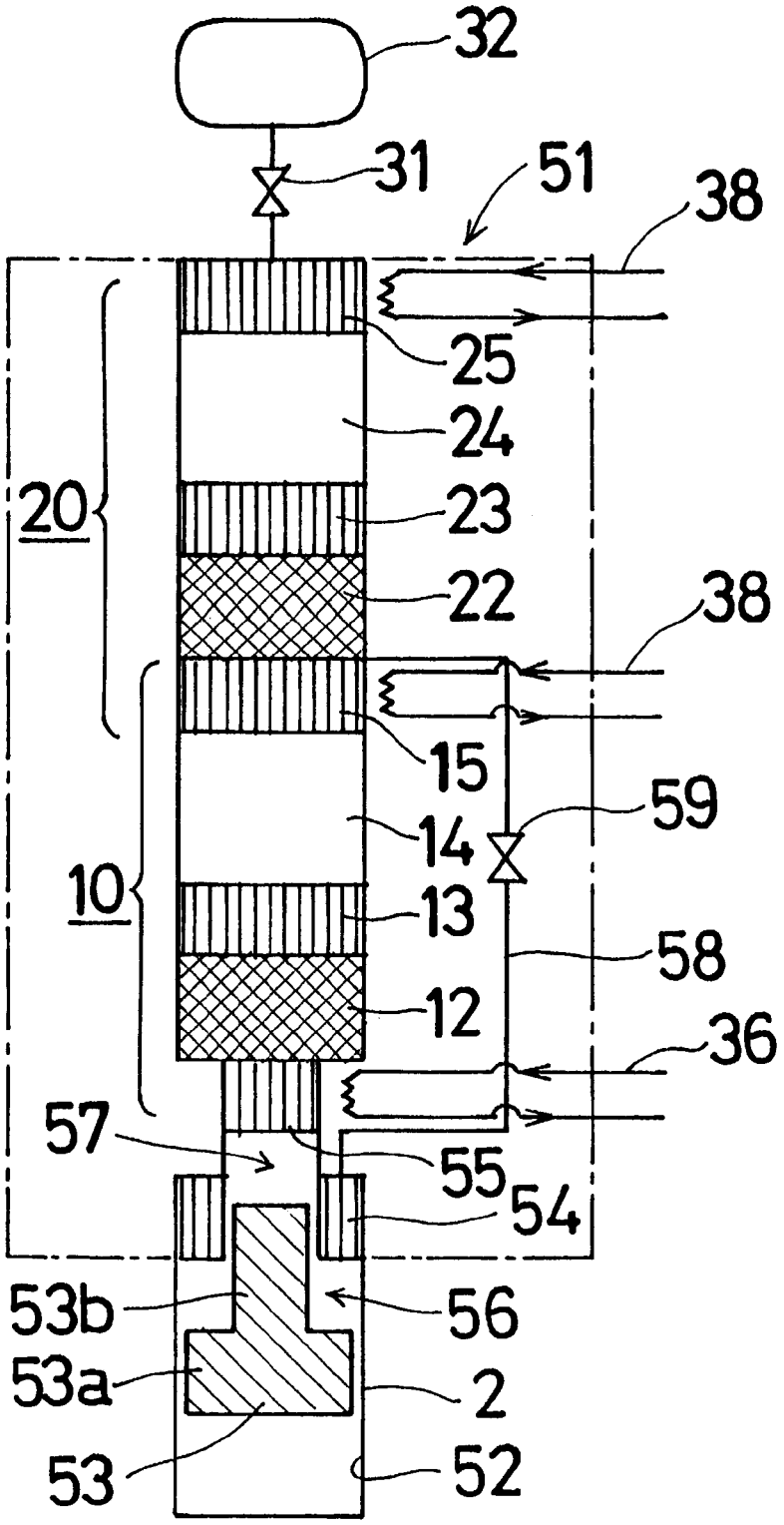
FIG. 3 is a schematic illustration of a pulse tube refrigerator according to a third embodiment of the present invention.

FIG. 3 illustrates a pulse tube refrigerator 51 according a third embodiment of the present invention. As shown in FIG. 3, the pulse tube refrigerator 51 possesses a two-step compression cylinder 52 and a two-step compression piston 53. The two-step compression cylinder 52 possesses a large diameter portion and a small diameter portion, and the two-step compressor piston 53 also possesses a large diameter portion 53*a* and a small diameter portion 53*b*. The large diameter portion 53*a* of the compression piston 53 reciprocates in the large diameter portion of the two-step compression cylinder 52 while the small diameter portion 53*b* of the compression piston 53 reciprocates in the small diameter portion of the two-step compression cylinder 52.

The first cooling device 11 is divided into two cooling devices 54, 55. One compression chamber 56 is defined between a front surface of the large diameter portion 53*a* of the compression piston 53 and the cooling device 54. Another compression chamber 57 is defined between the front surface of the small diameter portion 53*b* of the compression piston 53 and the cooling device 55.

A bypass 58 is provided in the first cooling part 10 and includes one end connected to the cooling device 54 and the other end connected at a portion between the first radiator 15 and the second regenerator 22. An orifice 59 Is interposed on the bypass 58. Accordingly, the pulse tube refrigerator 51 is a double inlet type pulse tube refrigerator.

The double inlet type pulse tube refrigerator shown in FIG. 3 is advantageously able to produce increased cooling power. With a typical double inlet type pulse tube refrigerator, or a circulation flow (DC flow) is generated. Because the hot end of the pulse tube is connected to the hot end of the regenerator directly through the bypass, a closed loop flow (a circulation flow) is formed. The circulation flow is from the bypass to the cooling part or from the cooling part to the bypass, and tends to decrease the cooling stability. However, this same circulation flow is not generated in the pulse tube refrigerator 51 according to the third embodiment of the invention because the compression chamber is divided into two compression chambers 56, 57. Thus, the compression chamber 56 is connected in series to the cooling device 54, the bypass 58, the first radiator 15, the first pulse tube 14, the first cold head 13, the first regenerator 12, the cooling device 55 and the compression chamber 57. The compression chamber 56 is divided or separated from the compression chamber 57 by the small diameter portion 53*b* of the compression piston 53. The compression chamber 56 thus does not directly communicate with the compression chamber 57 because of the existence of the small diameter portion 53*b* of the compression piston 53. The operating gas flow is divided by the piston 53 and so the generation of circulation flow in the pulse tube refrigerator 51 can be prevented. Thus, the pulse tube refrigerator 51 according to the third embodiment of the present invention has the additional advantage that the cooling stability of the refrigerator is improved by preventing the generation of circulation flow.

Figure 4:
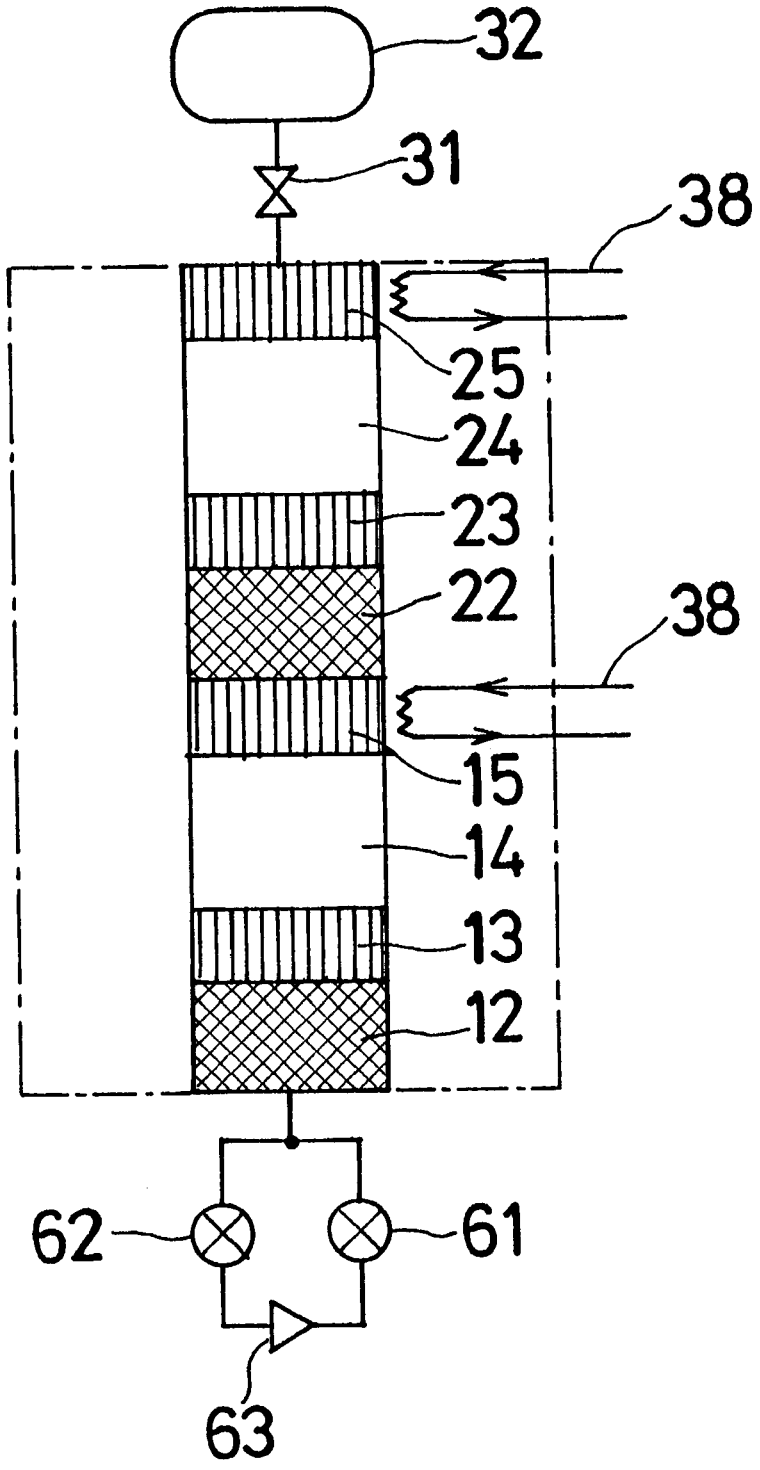
FIG. 4 is a schematic illustration of a pulse tube refrigerator according to another embodiment of the present invention.

While the pulse tube refrigerator of the present invention has been described with reference to what are presently considered to be several preferred embodiments of the invention, it is to be understood that the invention at issue is not limited to the disclosed embodiments or constructions. For example, although the reciprocating type compressor 2 is disclosed in the first embodiment, a compressor device such as the compressor 63 shown in FIG. 4 may be used. The compressor 63 has a high pressure on-off valve 61 and a low pressure on-off valve 62. The high pressure on-off valve 61 is connected to an exhaust port of the compressor device. The low pressure on-off valve 62 is connected to a suction port of the compressor device. The pressure oscillation is achieved by alternately switching between the high pressure on-off valve 61 or the low pressure on-off valve 62.

Figure 5:
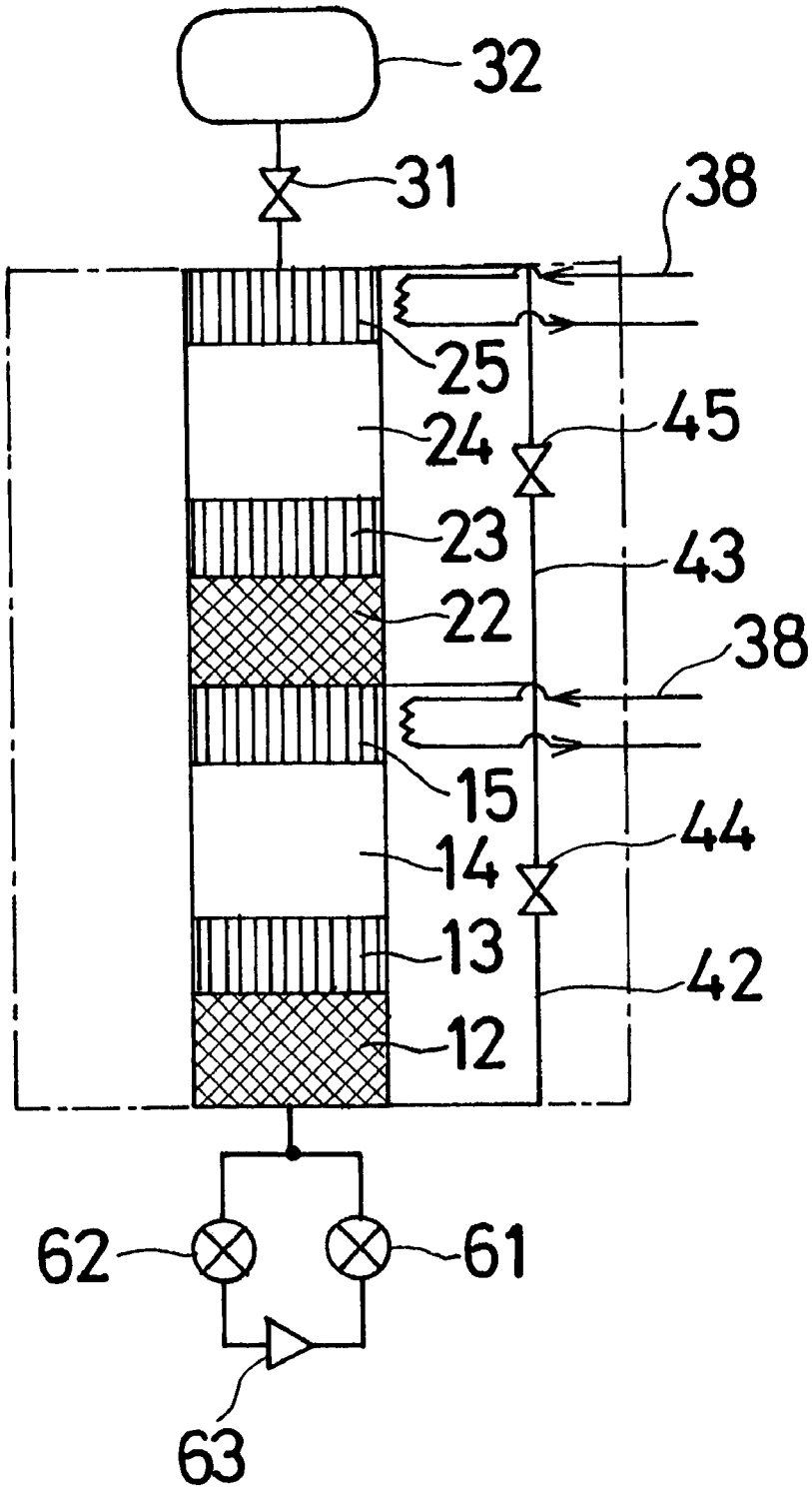
FIG. 5 is a schematic illustration of a pulse tube refrigerator according to a further embodiment of the present invention.

Similarly, although the reciprocating-type compressor is disclosed in the second embodiment, a similar compressor 63 having a high pressure on-off valve 61 and a low pressure on-off valve as shown in FIG. 5 may be employed.

Also, although the above-described embodiments utilize two cooling parts connected in series, it is to be understood that three or more cooling parts can be connected in series.

Figure 6:
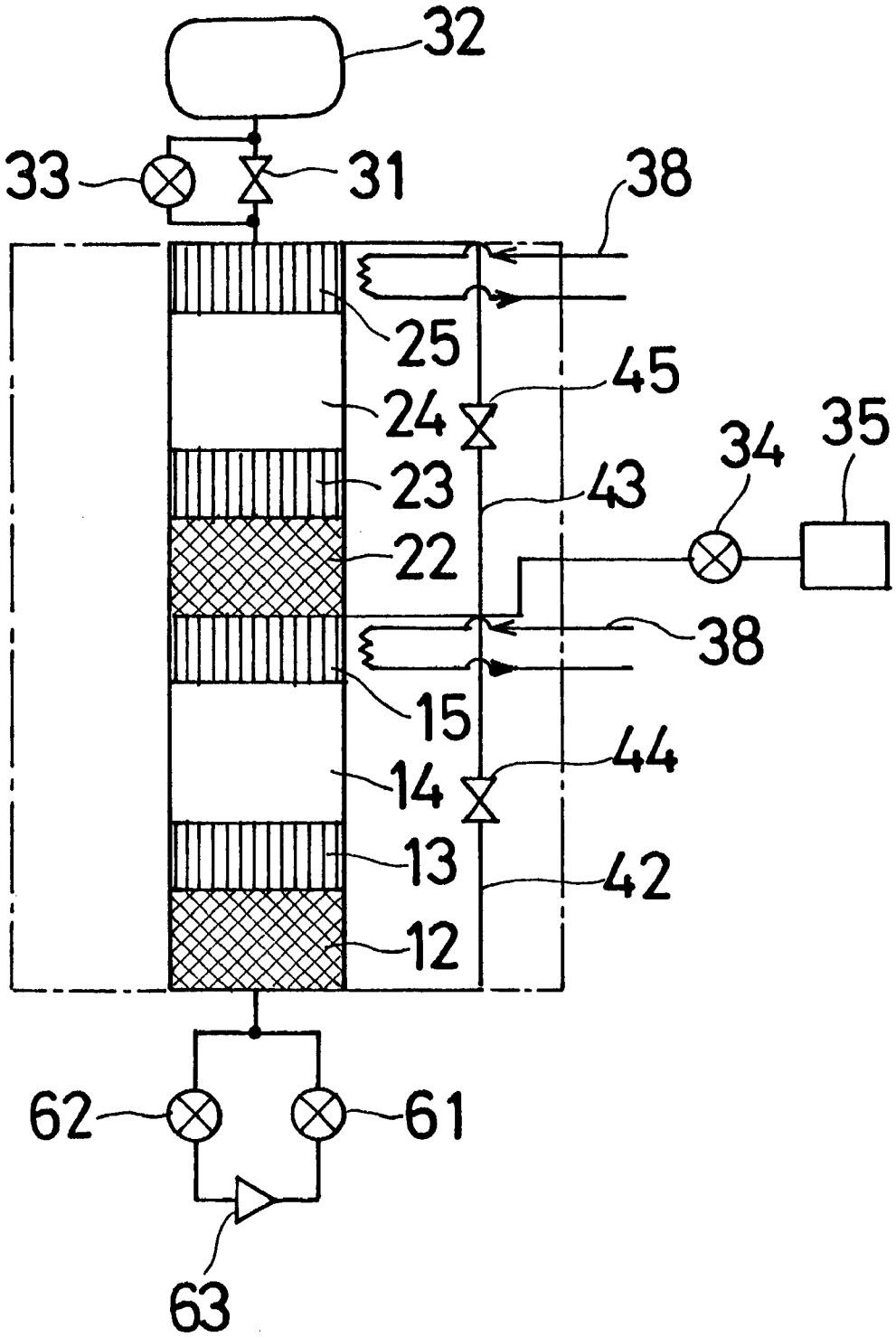
FIG. 6 is a schematic illustration of a pulse tube refrigerator according to a still further embodiment of the present invention.
Figure 7:
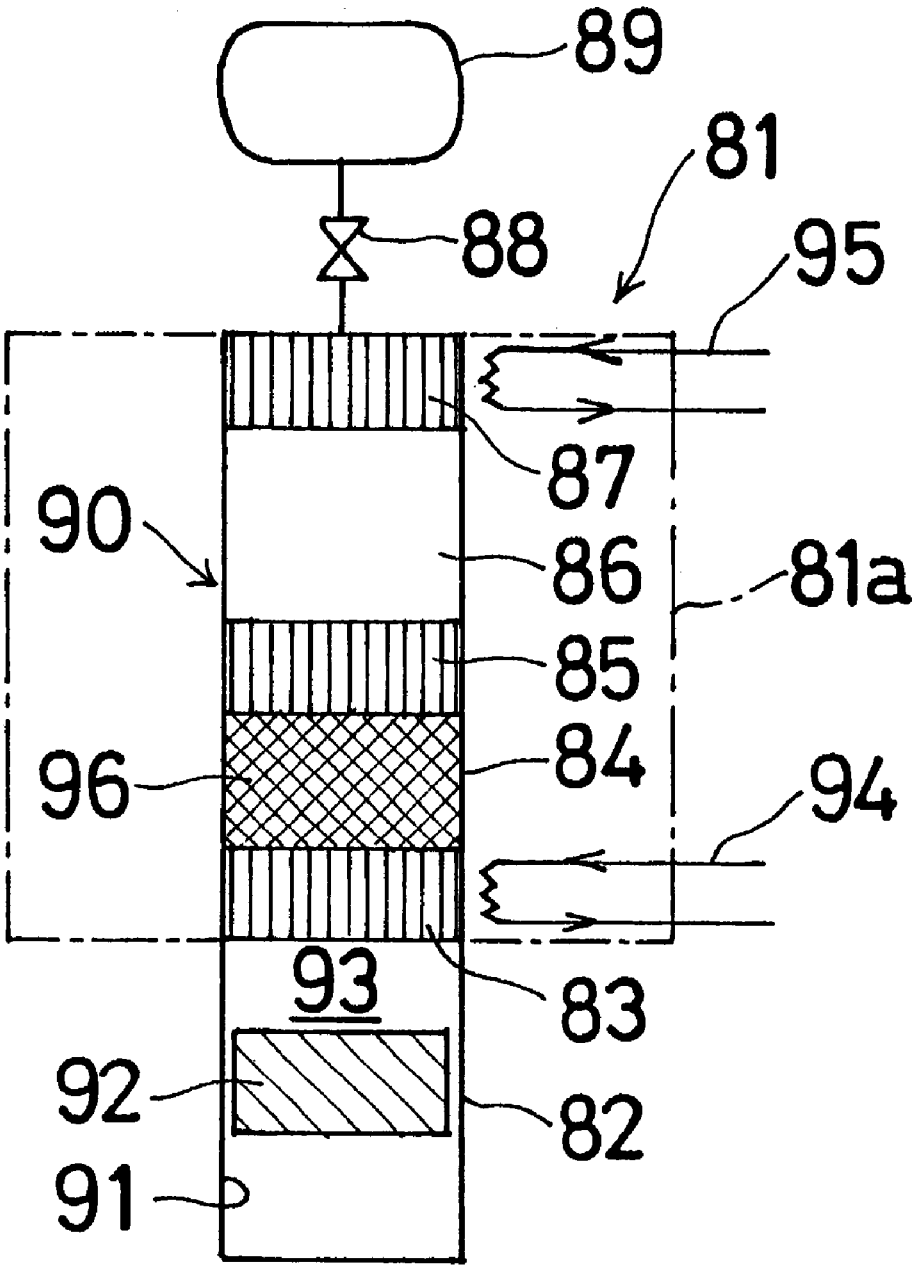
Fig. 7 Prior Art
FIG. 7 is a schematic illustration of known type of pulse tube refrigerator.

Further, the pulse tube refrigerator of the present invention may be constructed in the manner shown in FIG. 6. As shown in FIG. 6, two on-off valves 33, 34, and a buffer tank 35 are employed in the illustrated positions. According to this construction, the cooling power of the refrigerator is further improved.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A pulse tube refrigerator having a pressure oscillation source comprising:

a first regenerator having a hot end connected to the pressure oscillation source and a cold end;

a first cold head connected with the cold end of the first regenerator;

a first pulse tube having a hot end and a cold end, the cold end of the first pulse tube being connected to the first cold head;

the first regenerator, the first cold head and the first pulse tube forming a first cooling part;

a second regenerator having a hot end and a cold end, the hot end of the second regenerator being connected to the hot end of the first pulse tube;

a second cold head connected to the cold end of the second regenerator;

a second pulse tube having a hot end and a cold end, the second pulse tube being connected to the cold end of the second cold head;

the second regenerator, the second cold head and the second pulse tube forming a second cooling part.

2. The pulse tube refrigerator according to claim 1, wherein expansion work of an operating gas performed in the first cooling part is used for compression work of the second cooling part.

3. The pulse tube refrigerator according to claim 1, further comprising a phase shifter for adjusting a phase difference between pressure oscillation and displacement oscillation of an operating gas in the first cooling part and the second cooling part, said phase shifter being connected with the hot end of the second pulse tube.

4. The pulse tube refrigerator according to claim 3, wherein the phase shifter includes a buffer tank and an orifice, the buffer tank being connected to the hot end of the second pulse tube via the orifice.

5. The pulse tube refrigerator according to claim 1, further comprising a first bypass having a first end and a second end, the first end of the first bypass being connected to the pressure oscillation source and the second end of the first bypass being connected to the hot end of the first pulse tube.

6. The pulse tube refrigerator according to claim 1 further comprising a second bypass having a first end and a second end, the first end of the second bypass being connected to the hot end of the first pulse tube, and the second end of the second bypass being connected the hot end of the second pulse tube.

7. The pulse tube refrigerator according to claim 1, wherein the pressure oscillation source has a first compression chamber connected with the first regenerator and a second compression chamber communicating with the hot end of the first pulse tube.

8. A pulse tube refrigerator according to claim 7, further comprising a bypass connecting the second compression chamber to the hot end of the first pulse tube.

9. A pulse tube refrigerator comprising:

a first cooling part having a regenerator, a cold head and a pulse tube arranged in series, the pulse tube being adapted to generate expansion work of operating gas in the first cooling part;

a second cooling part connected to the first cooling part;

the expansion work of the operating gas generated by the first cooling part being used as a compressor for operating gas in the second cooling part.

10. The pulse tube refrigerator according to claim 9, further comprising a phase shifter connected to the second cooling part for adjusting a phase difference between pressure oscillation and displacement oscillation of an operating gas in the first cooling part and the second cooling part.

11. The pulse tube refrigerator according to claim 10, wherein the phase shifter includes a buffer tank and an orifice, the buffer tank being connected to the second cooling part via the orifice.

12. The pulse tube refrigerator according to claim 9, further comprising a bypass having a first end and a second end, the first end of the first bypass being connected to the pressure oscillation source and the second end of the first bypass being connected to an end of the pulse tube.

13. The pulse tube refrigerator according to claim 9, further comprising a bypass having a first end and a second end, the first end of the bypass being connected to an end of the pulse tube and the second end of the bypass being connected to a portion of the second cooling device.

14. The pulse tube refrigerator according to claim 13, wherein the second cooling device includes a pulse tube, the second end of the bypass being connected to an end of the pulse tube of the second cooling device.

15. The pulse tube refrigerator according to claim 9, wherein the pressure oscillation source includes a first compression chamber connected with the first regenerator and a second compression chamber communicating with an end of the first pulse tube.

16. A pulse tube refrigerator comprising:

a series of cooling parts having one end side and another end side, each cooling part comprising a regenerator, a cold head, and a pulse tube that are connected in series;

a pressure oscillation source connected to the one end side of the series of cooling parts.

17. A pulse tube refrigerator according to claim 16, further comprising a phase shifter for adjusting a phase difference between pressure oscillation and displacement of an operating gas in the cooling parts, said phase shifter being connected to said another end side of the series of cooling parts.

18. A pulse tube refrigerator according to claim 17, wherein the phase shifter includes a buffer tank and an orifice positioned between the buffer tank and said another end side of the series of cooling parts so that the buffer tank is connected to said another end side of the series of cooling parts via the orifice.

19. A pulse tube refrigerator according to claim 16, wherein expansion work of an operating gas performed in one of the cooling parts is used for compression work of the other cooling part.

* * * * *